United States Patent [19]

Stock

[11] Patent Number: 4,866,941

[45] Date of Patent: Sep. 19, 1989

[54] SINGLE CONDENSER ARRANGEMENT FOR SIDE EXHAUST TURBINE

[75] Inventor: Alvin L. Stock, Casselberry, Fla.

[73] Assignee: Westinghouse Electric Corp., Pittsburgh, Pa.

[21] Appl. No.: 215,097

[22] Filed: Jul. 5, 1988

[51] Int. Cl.[4] ..... F01K 11/02

[52] U.S. Cl. ..... 60/692; 60/690

[58] Field of Search ..... 60/690, 692

[56] References Cited

U.S. PATENT DOCUMENTS

| | | | |
|---|---|---|---|
| 899,547 | 9/1908 | Lindmark | 60/690 |
| 1,969,695 | 8/1934 | Hendricks, Jr. | 60/690 X |
| 3,808,819 | 5/1974 | Engelke et al. | 60/690 |
| 4,653,277 | 3/1987 | Bozec | 60/692 |

OTHER PUBLICATIONS

2 Figures from American Electric Power, P-72903, 72904 (No Date).

*Primary Examiner*—Allen M. Ostrager

[57] ABSTRACT

The present invention pertains to an apparatus for converting steam energy into electrical energy. The apparatus includes a turbine capable of converting steam energy into mechanical energy. The apparatus also includes a generator for converting mechanical energy into electrical energy. Additionally, there is a shaft disposed in and connecting the turbine and the generator along a center line. The shaft is capable of being turned by the steam energy of the turbine. There is also a single condenser connected to the turbine. The single condenser is capable of drawing steam out of the turbine and condensing steam to water. The single condenser is disposed alongside the turbine.

15 Claims, 2 Drawing Sheets

SINGLE CONDENSER ARRANGEMENT FOR SIDE EXHAUST TURBINE

FIELD OF THE INVENTION

The present invention relates to a turbine-generator apparatus for converting steam energy to electrical energy. More specifically, the present invention relates to a steam turbine-generator apparatus which utilizes a single condenser mounted alongside the turbine to afford the use of a low foundation.

BACKGROUND OF THE INVENTION

Conventional steam turbines employ one of two exhaust orientations. One such orientation places the condenser (to which the exhaust must lead) below the turbine. This requires a large foundation on the order of 40 to 50 feet in height. In this orientation the vacuum load created by the condenser helps anchor the turbine to the foundation, which is particularly helpful in earthquake shock loading situations.

The problems associated with such a large foundation are two fold. First, such a design requires an enormous quantity of steel reinforced concrete and I-beams. Second, the foundation must be very rugged and the more extended it is, the more difficult it becomes to achieve this ruggedness, the necessary specifications being in terms of lateral and transverse vibration dynamics, earthquake response, etc.

The other commonly used orientation eliminates the need for such a tall foundation by placing condensers on either side of the turbine and running the exhaust to both. The reason two condensers are used is that by placing one on either side the vacuum load created by the condensers can be used to balance each other and not displace the turbine from the center line of the shaft.

The problem with this two condenser side exhaust design is the cost of the additional condenser, which is used not so much for its condensing capacity, as it is as a means of balancing the load on the turbine.

In addition, the advent of combined cycle power plants that can use a combination of fossil fuels and nuclear energy for their operation requires an overall structure for supporting the different energy sources. The use of a large foundation in combined cycle power plants is not suitable for use in a combined cycle power plant.

SUMMARY OF THE INVENTION

The present invention pertains to an apparatus for converting steam energy into electrical energy. The apparatus comprises a turbine capable of converting steam energy into mechanical energy. The apparatus also comprises a generator for converting mechanical energy into electrical energy. Additionally, there is a shaft disposed in and axially connecting the turbine and the generator. The shaft is capable of being turned by the steam energy of the turbine. There is also a single condenser connected to the turbine. The single condenser is capable of drawing steam out of the turbine and condensing steam to water. The single condenser is disposed alongside the turbine.

In a preferred embodiment the turbine has a low pressure region, and the apparatus is also comprised of a low pressure exhaust that is connected to the single condenser. Steam in the low pressure region is capable of passing into the condenser through the low pressure exhaust. A vacuum anchor fixedly secures the turbine to the low foundation. A rigid joint is disposed between the low pressure exhaust and the condenser for securing the low pressure exhaust to the condenser. There are feet and axial anchors which vertically and axially secure the turbine to a low foundation. Moreover, springs, flexiplates or sliding supports can be used to flexibly mount the condenser to a slab and allow for thermal expansion transverse to the turbine centerline. The slab supports the condenser and the low foundation.

Other details, objects and advantages of the invention will become apparent as the following description of the presently preferred embodiments and presently preferred methods of practicing the invention proceeds.

BRIEF DESCRIPTION OF THE DRAWINGS

In the accompanying drawings, the preferred embodiments of the invention and preferred methods of practicing the invention are illustrated, in which.

DESCRIPTION OF THE PREFERRED EMBODIMENTS

Figure 1:
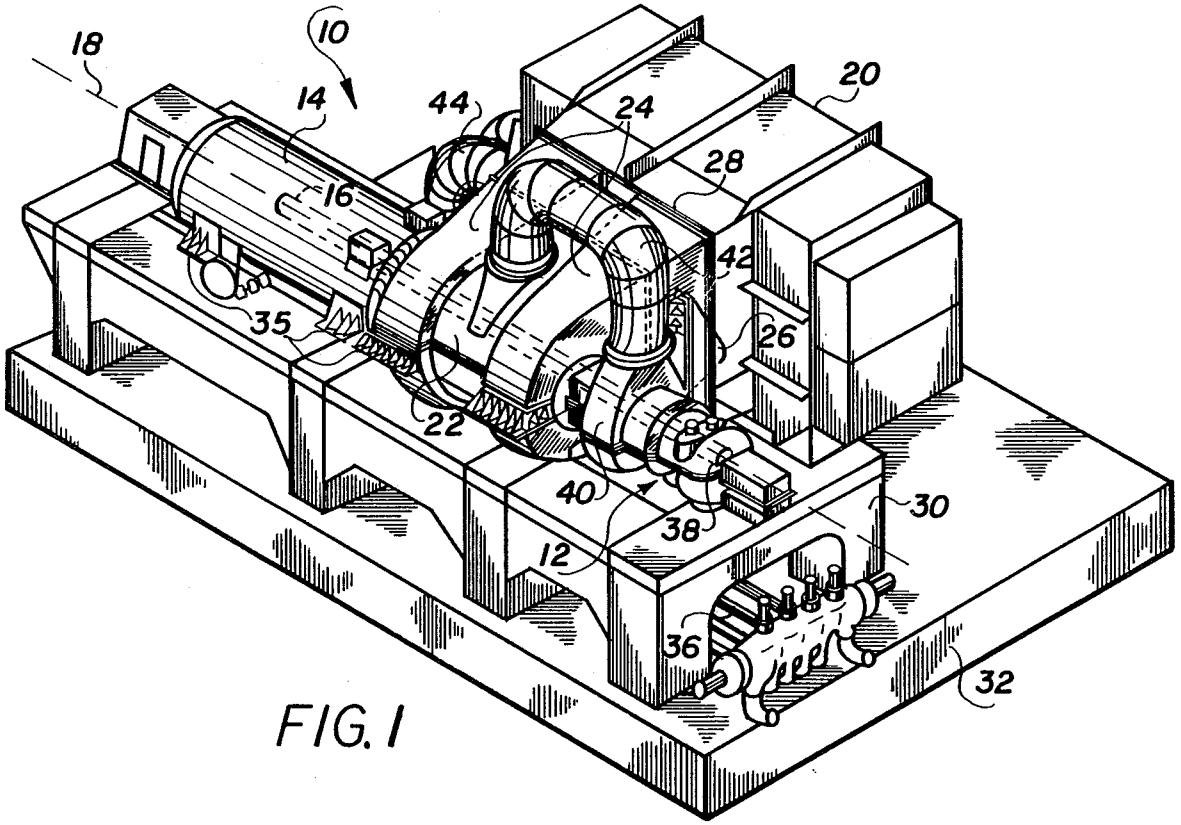
FIG. 1 is a perspective view of an apparatus for converting steam energy into electrical energy.

Referring now to FIG. 1, there is shown a perspective view of an apparatus 10 for converting steam energy into electrical energy. The apparatus 10 comprises a turbine 12 capable of converting steam energy into mechanical energy. The apparatus 10 also comprises a generator 14 for converting mechanical energy into electrical energy. There is also a shaft 16 disposed in and axially connecting the turbine 12 and the generator 14 preferably along a center line 18. The shaft 16 is capable of being turned by the steam energy in the turbine 12. Additionally, a single condenser 20 is connected to the turbine 12. The single condenser 20 is capable of drawing steam out of the turbine 12 and condensing steam to water. The single condenser 20 is positioned laterally alongside the turbine 12.

Preferably, the turbine 12 has a low pressure region 22. A low pressure exhaust 24 is connected to the single condenser 20. Steam in the low pressure region 22 is capable of passing into the single condenser 20 through the low pressure exhaust 24. The low pressure exhaust 24 is positioned about the center line 18 of the low pressure region 22 in the turbine 12. The single condenser 20 is fluidically connected with the low pressure region 22 in the turbine 12 such that the shaft 16 is essentially not displaced from the center line 18 by the single condenser 20 as it draws steam from the low pressure region 22 in the turbine 12.

Figures 2, 3:
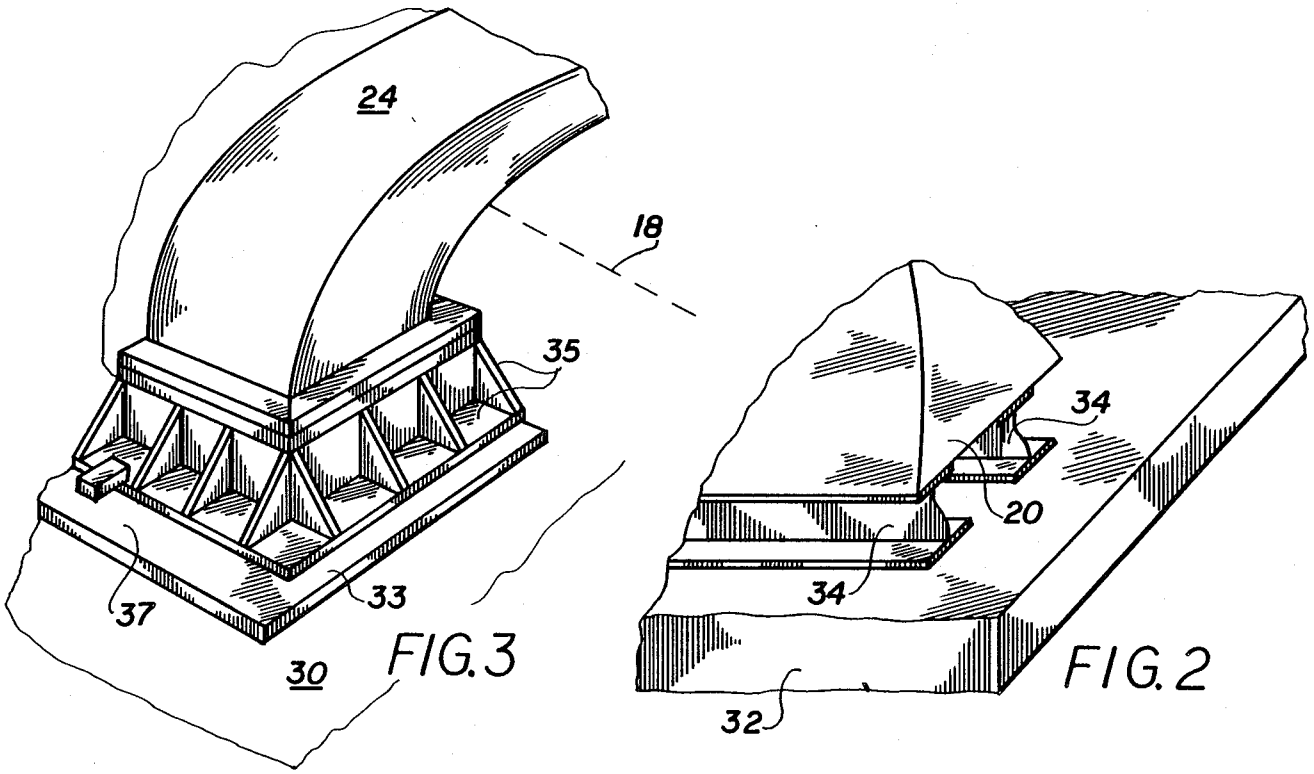
FIG. 2 is a fragmentary side view of a portion of a single condenser and a flex plate.
FIG. 3 is a fragmentary perspective view of the low pressure exhaust with respect to the low foundation.

The low pressure region 22 of the turbine 12 is preferably transversely secured to the foundation 30 by a vacuum anchor 26 and vertically secured to the foundation 30 by feet 35 at a position as close to the turbine centerline as possible, and preferably on the centerline by way of being positioned on transverse and vertical planes, respectively, that pass through the centerline. The feet 35 are, preferably, fixed to the low foundation 30 by way of a seating plate 33 disposed therebetween as shown in FIG. 3. The low pressure exhaust 24 is preferably secured to the single condenser 20 by a rigid joint 28 disposed between the low pressure exhaust 24 and the single condenser 20.

A low foundation 30, preferably only slightly greater than ½ the height of the condenser, supports the turbine 12 and the generator 14. A slab 32 supports the low foundation 30 and the single condenser 20. The low pressure turbine 12 and generator 14 are axially anchored to the low foundation 30 by axial anchors 37 which allow transverse sliding to accommodate thermal expansion from the turbine centerline. Springs, sliding supports or preferably flexiplates 34 are used to flexibly mount the single condenser 20 to the slab 32 as shown in FIG. 2.

In the operation of the invention, steam is introduced through pipes 36 into a high pressure region 38 of the turbine 12. The steam in the high pressure region 38 of the turbine 12 is used to turn the shaft or rotor 16. Steam is removed from the high pressure region 38 of the turbine 12 through the pipes 36 to be reheated. The reheated steam is introduced through pipes 36 to the intermediate pressure region 40 of the turbine 12 where it is used to turn the shaft 16. Steam from the intermediate pressure region 40 of the turbine 12 is introduced into the low pressure region 22 of the turbine 12 through a crossover pipe 42. Steam in the low pressure region 22 of the turbine 12 is used to turn the shaft 16. The rotating shaft 16 causes electricity to be produced in the generator 14, as is well known in the art.

Steam from the low pressure region 22 of the turbine 12 is drawn through the low pressure exhaust 24 into the single condenser 20 under the force of a vacuum load therefrom. Vacuum anchor 26 secures the turbine 12 against the vacuum load created by the single condenser 20. In addition, rigid joint 28 is also used to secure the low pressure exhaust 24 to the single condenser 20 with respect to the vacuum load created by the single condenser 20. The use of the rigid joint 28 and the vacuum anchor 26 results in the single condenser 20 and the turbine 12 forming one structurally integral unit.

The single condenser 20 condenses the steam to water where it is returned through pipes (not shown) to the boiler for heating. The vacuum load on the low pressure exhaust 24 from the single condenser 20 is determined by the amount of steam the single condenser 20 is condensing to water and the temperature at which the condensing of the steam to water is occurring, as is well known in the art.

Feet 35 secure the turbine 12 and generator 14 to the low foundation 30. The low foundation 30 and the single condenser 20 are supported by the slab 32. The single condenser 20 is flexibly mounted to the slab 32 with flexiplates 34. The single condenser 20 is allowed to move in response to thermal expansion forces on the flexiplates 34 while the generator 14 and turbine 12 slide on their respective feet 35. Vertical anchors such as the feet 35 and transverse anchor, such as the vacuum anchor 26, maintain the alignment of the turbine 12 and generator 14 to the shaft 16.

Although the invention has been described in detail in the foregoing for the purpose of illustration, it is to be understood that such detail is solely for that purpose and that variations can be made therein by those skilled in the art without departing from the spirit and scope of the invention as described by the following claims.

What is claimed is:

1. A large-scale power generating apparatus for converting steam energy into electrical energy comprising:

a large turbine capable of converting steam energy into mechanical energy;

a large generator for converting mechanical energy into electrical energy;

a shaft disposed in and axially connecting the turbine and the generator, said shaft capable of being turned by steam energy in the turbine;

a single condenser connected to the turbine and capable of drawing steam out of the turbine and condensing steam to water, said single condenser disposed alongside the turbine; and a low foundation which supports the turbine and the generator and a slab which supports the low foundation and the single condenser.

2. An apparatus as defined in claim 1 wherein the turbine has a low pressure region, and there is included a low pressure exhaust that is connected to the single condenser through which steam in the low pressure region is capable of passing into the single condenser.

3. An apparatus as described in claim 2 wherein there is a center line along which the shaft axially connects the turbine and the generator; and the low pressure exhaust is positioned about the center line of the low pressure region in the turbine and the single condenser is fluidically connected with the low pressure region in the turbine such that the shaft is not displaced from the center line by the single condenser as it draws steam from the low pressure region in the turbine.

4. An apparatus as described in claim 1 which includes a vacuum anchor for transversely securing the turbine to the low foundation.

5. An apparatus as defined in claim 4 including a rigid joint disposed between the low pressure exhaust and the single condenser for securing the low pressure exhaust of the turbine to the single condenser.

6. An apparatus as described in claim 5 including feet and axial anchors which vertically and axially, respectively, secure the turbine to the low-foundation while allowing for transverse thermal expansion movement.

7. An apparatus as described in claim 6 including springs, flexiplates or sliding supports with which the single condenser is flexibly mounted to the slab while allowing for transverse thermal expansion movement.

8. An apparatus for converting steam energy into electrical energy comprising:

a turbine capable of converting steam energy into mechanical energy;

a generator for converting mechanical energy into electrical energy;

a shaft disposed in and axially connecting the turbine and the generator, said shaft capable of being turned by steam energy in the turbine;

a single condenser connected to the turbine and capable of drawing steam out of the turbine and condensing steam to water, said single condenser disposed alongside the turbine; and a low foundation which supports the turbine and the generator and a slab which supports the low foundation and the single condenser.

9. An apparatus as defined in claim 8 wherein the turbine has a low pressure region; and there is included a low pressure exhaust that is connected to the single condenser through which steam in the low pressure region is capable of passing into the single condenser.

10. An apparatus as described in claim 9 wherein there is a center line along which the shaft axially connects the turbine and the generator; and the low pressure exhaust is positioned about the center line of the low pressure region in the turbine and the single condenser is fluidically connected with the low pressure region in the turbine such that the shaft is not displaced from the center line by the single condenser as it draws steam from the low pressure region in the turbine.

11. An apparatus as described in claim 10 wherein the condenser is flexibly mounted to the slab.

12. An apparatus as described in claim 11 which includes a vacuum anchor for transversely securing the turbine to the low foundation.

13. An apparatus as defined in claim 12 including a rigid joint disposed between the low pressure exhaust and the single condenser for securing the low pressure exhaust of the turbine to the single condenser.

14. An apparatus as described in claim 13 including feet and axial anchors which vertically and axially, respectively, secure the turbine to the low-foundation while allowing for transverse thermal expansion movement.

15. An apparatus as described in claim 14 including springs, flexiplates or sliding supports with which the single condenser is flexibly mounted to the slab while allowing for transverse thermal expansion movement.

* * * * *